United States Patent [19]

Lichtenberger

[11] Patent Number: 5,032,464

[45] Date of Patent: Jul. 16, 1991

[54] ELECTRODEPOSITED AMORPHOUS DUCTILE ALLOYS OF NICKEL AND PHOSPHORUS

[75] Inventor: John A. Lichtenberger, Beavercreek, Ohio

[73] Assignee: Burlington Industries, Inc., Greensboro, N.C.

[21] Appl. No.: 923,270

[22] Filed: Oct. 27, 1986

[51] Int. Cl.[5] ..... B32B 15/04; C25D 3/56

[52] U.S. Cl. ..... 428/596; 428/606; 428/457; 428/935; 148/403; 204/44.7

[58] Field of Search ..... 204/44.7; 428/680, 606, 428/457, 607, 596, 935; 148/403

[56] References Cited

U.S. PATENT DOCUMENTS

| | | | |
|---|---|---|---|
| 2,198,267 | 4/1940 | Lind | 428/680 |
| 2,643,221 | 6/1953 | Brenner et al. | 204/44.7 |
| 4,148,973 | 4/1979 | Sexton et al. | 428/606 |
| 4,184,925 | 1/1980 | Kenworthy | 204/11 |
| 4,229,265 | 10/1980 | Kenworthy | 204/11 |
| 4,429,021 | 1/1984 | Higashi | 428/680 |
| 4,528,070 | 6/1985 | Gamblin | 204/24 |
| 4,528,577 | 7/1985 | Cloutier et al. | 346/140 R |
| 4,554,219 | 11/1985 | Gamblin | 204/44.7 |

FOREIGN PATENT DOCUMENTS

| | | | |
|---|---|---|---|
| WO86/07100 | 12/1986 | Int'l Pat. Institute . | |
| 53-104653 | 3/1980 | Japan . | |
| 50190 | 3/1984 | Japan | 204/44.7 |

OTHER PUBLICATIONS

Yamasaki et al., "The Microstructure and Fatigue Properties of Electroless Deposited Ni-P Alloys", Pergamon Press Ltd., Scripta Metallurgica, vol. 15, pp. 177-180, 1981.

ASTM publication, pp. 327, 328 designation B490, 1980, "Standard Practice for Micrometer Bend Test for Ductility of Electrodeposits".

*Primary Examiner*—John J. Zimmerman

*Attorney, Agent, or Firm*—Nixon & Vanderhye

[57] ABSTRACT

Smooth, specular, ductile alloys of a transition metal and phosphorus (particularly nickel phosphorus) are produced. The ductility is such that when the alloy is in the form of a foil having a thickness up to or greater than 1 mil (i.e. greater than can be obtained by splat cooling) it can be formed into a complex geometric shape, such as a helix, without cracking, and has a ductility comparable to at least about 5 percent (possibly even over 10 percent) for a 25 micron foil subjected to the ASTM Micrometer Bend Test for Ductility of Electrodeposits. The alloy is deposited on a substrate by electroplating in a bath comprising about 0.5-1.0 molar nickel, about 1.5-3.0 molar phosphorous acid, about 0.1-0.6 molar phosphoric acid, and about 0.0-0.6 molar hydrochloric acid, with chloride ion in the amount of at least 1.25M, and greater than twice as much chloride as nickel. While the bath contains significant amounts of hydrochloric acid, in order to maintain nitric acid or warm ferric chloride corrosion resistance of the alloy, the chloride ion is limited to about 2.0 molar.

13 Claims, 2 Drawing Sheets

ELECTRODEPOSITED AMORPHOUS DUCTILE ALLOYS OF NICKEL AND PHOSPHORUS

BACKGROUND AND SUMMARY OF THE INVENTION

It has been known for many years that amorphous alloys of metals and non-metals combinations (particularly transition metal-phosphorus alloys such as nickel phosphorus alloys) have many desirable properties, including excellent corrosion resistance, controllable magnetic and electrical responses, good wear properties, and unusual mechanical behavior Present methods for producing amorphous nickel phosphorus alloys, or like alloys of metal and non-metal combinations, each have significant drawbacks. For instance, the technique of splat cooling in which the alloy is rapidly solidified from the melt offers only limited applications, as it has constraints which limit the geometries of the end products to ribbons or sheets. While splat cooling can achieve a product of desirable ductility, the splat cooled coating has a maximum achievable thickness of 1 mil.

Vacuum deposition methods also are known, but they are inherently rate limited to thin coatings in reasonable time periods. Plasma arc deposition produces non-compact coatings with low densities. Electroless deposition produces brittle coatings at rates rarely in excess of 0.0008 inches per hour, often unacceptable for commercial processes.

Electrodeposited alloys of transition metals and phosphorus, such as alloys of nickel and/or cobalt and phosphorus, have reasonably good deposition rates (0.001 inch–0.005 inch per hour), result in a product that is superior from a corrosion resistance standpoint, and have a wide variety of other advantages. However, typical electrodeposition techniques produce alloys having limited ductility (e.g. about 1 percent elongation). This limited ductility prevents forming operations after coating, and results in limitations on deposition rates utilizing standard operating conditions in the electroplating industry.

According to the present invention, the advantages of electrodeposition of transition metal-phosphorus alloys can be maintained while at the same time producing alloys having sufficiently good ductility properties so that the alloys may be used on many products where their use is presently precluded. Examples of such areas of use include magnetic recording tape and textile printing screens. The alloy can be used in making orifice plates according to the teachings of U.S. Pat. No. 4,528,070 commonly assigned herewith. Orifice plates can be made by plating the transition metal-phosphorus alloy (typically nickel and/or cobalt phosphorus alloy) on a substrate such as stainless steel, and then stripping the transition metal-phosphorus alloy off the stainless steel so that the alloy has a foil configuration that serves as its own orifice plate and support. These are merely a few examples of a wide variety of uses to which alloy film configurations according to the invention can be put, either as coatings on substrates, or as unsupported foils.

The nickel phosphorus alloys according to the present invention have greatly enhanced ductility properties, whether measured qualitatively or quantitatively. For example, as a representation of the excellent ductility properties which may be demonstrated qualitatively, an unsupported amorphous nickel phosphorus alloy foil can be produced according to the invention having a thickness of greater than 1 mil (i.e. greater than can be obtained by splat cooling) and having ductility properties such that it may be formed into a complex geometric shape, such as twisted into a helix or accordion folded, without cracking. In addition, the alloy according to the invention is fully specular in appearance when plated to any thickness (i.e. it is highly reflective without distortion), and it maintains the structure and integrity of the underlying surface as prepared for coating, without degradation of the surface smoothness. The alloy can be deposited at conventional electrodeposition rates, i.e. at least about 0.001 inch per hour, and has been applied at rates up to and above about 0.020 inch per hour.

Measured quantitatively, if a film configuration of alloy according to the present invention is in foil form, its ductility is comparable to at least about 5 percent (and can be greater than about 10 percent) for a 25 micron foil subjected to the ASTM Standard Practice for Micrometer Bend Test for Ductility of Electrodeposits (ASTM designation B490-68 as reapproved 1980).

The preferred alloy according to the present invention is produced in an electroplating bath which typically comprises about 0.5–1.0 molar nickel chloride, about 1.5–3.0 molar phosphorous acid, about 0.1–0.6 molar phosphoric acid, and about 0.0–0.6 molar hydrochloric acid. The bath must have at least 1.25M $Cl^-$, and there must be at least twice the amount of $Cl^-$ in the bath as $Ni^{+2}$. While the exact mechanism that results in the desired end product according to the invention is not completely understood, it is believed that the enhanced ductility achieved according to the invention is due to lower amounts of codeposited hydrogen in the electrodeposit, brought about by the presence of hydrochloric acid, and an excess of chloride ions with respect to nickel ions in the bath. However, if the alloy is to remain resistant to nitric acid corrosion, the upper limit of the chloride in the bath is about 2.0 molar.

It is the primary object of the present invention to produce transition metal phosphorus alloy film configurations, and particularly nickel phosphorus coatings or unsupported foils, having excellent ductility, while retaining good corrosion resistance typical of such alloys. This and other objects of the invention will become clear from an inspection of the detailed description of the invention, and from the appended claims.

DETAILED DESCRIPTION

A typical bath according to the present invention for producing electrodeposits of nickel with phosphorus of improved ductility, at high rates, while maintaining corrosion resistance and smooth surface, comprises: about 0.5–1.0 molar nickel (as metal, e.g. from nickel chloride), about 1.5–3.0 molar phosphorous acid, about 0.1–0.6 molar phosphoric acid, and about 0.0–0.6 molar hydrochloric acid (preferably some HCl, e.g. a substantial amount, i.e. 0.1M or greater). Typical operating conditions for the bath are: maintaining a cathode current density of between about 20–800 ma/sq.cm., an operating temperature of between about 55°–95° C., with continuous filtration and moderate agitation.

EXAMPLE 1

An anodically cleaned (so that the deposit would easily strip off) stainless steel substrate was immersed in a bath as a cathode. The composition of the bath was:

| | |
|---|---|
| nickel (as metal) | about 1.0 molar |
| phosphorous acid | about 1.75 molar |
| phosphoric acid | about 0.35 molar |
| hydrochloric acid | about 0.5 molar |

The bath when analyzed had the following concentrations of ions: $Ni^{+2}=0.95M$; $PO_3=1.5M$; $Cl^-=1.95M$; $PO_4^{-3}=0.61M$. Note that the $Cl^{31}$ level was greater than twice the $Ni^{+2}$ level, and greater than 1.25M. The electrodeposition continued until the coating had a thickness of approximately 0.005 inches, at which point it was removed from the bath. The nickel phosphorus alloy, which was amorphous and specular, was then stripped off the stainless steel to provide a free-standing sample. The sample was then bent around a ⅛ inch rod and elongation was found to be 2.4 percent at set, and 4.8 percent at fracture.

EXAMPLE 2

Figure 4:
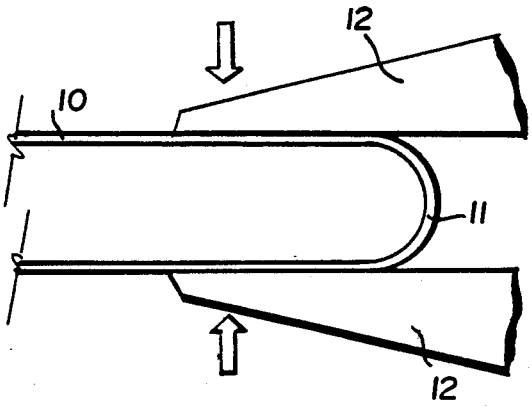
FIG. 4 is a schematic representation of a foil according to the present invention being subjected to the ASTM Micrometer Bend Test for Ductility of Electrodeposits, to quantitatively determine the ductility thereof.

The thinner the alloy film configuration, the better the apparent ductility. In this example the same bath as in Example 1 was utilized but plating was continued only until the film configuration was about 0.001 inches (25 microns) thick. Again, the specular amorphous nickel phosphorus alloy was stripped from the stainless steel substrate to provide a free-standing sample. This time the sample was subjected to the ASTM Micrometer Bend Test for Ductility of Electrodeposits. This test is illustrated schematically in FIG. 4. First the thickness of the foil is measured with the micrometer at the point of bending. Then the test foil 10 is bent into the shape of a U, with the U bend portion 11 placed between the flat jaws 12 of the micrometer so that as the jaws are closed, the U bend portion 11 remains between them. The jaws are closed slowly until the foil cracks. The micrometer reading is recorded as 2R, and the thickness of the foil is T. The ductility, in percent, is then equal to 100 T/(2R-T). Using this test, the sample according to this example was found to have a ductility of 7.14 percent. It was also noted that the deposit did not actually fracture even at deformations corresponding to 100 percent ductility (that is a bend radius equal to the deposit thickness); rather, the deposit remained coherent (that is as a single piece) with microscopic cracks visible on the surface.

EXAMPLE 3

In this example the constituents of the bath were similar to those in Example 2. Again a stainless steel substrate was immersed as a cathode in the bath and electrodeposition continued until a deposit of about 0.001 inches in thickness was formed. The deposit was stripped from the substrate and subjected to the ASTM test, and was found to have a ductility of 5.26 percent, again with good corrosion resistance, smoothness, and a specular appearance. The ductility here was different than in Example 2 only because the bath constituents change slightly over time, and it is difficult to stop plating at exactly the desired thickness so that the plating thicknesses differed slightly.

EXAMPLE 4

In this example the constituents of the bath were:

Ni (metal) 0.9M, 2.4M phosphorous acid, 0.4M phosphoric acid, and 0.38M HCl ($Ni^{+2}=0.9M$, $Cl^-=1.98M$).

Again a stainless steel substrate was immersed as a cathode in the bath and electrodeposition continued until a deposit of about 0.001 inches in thickness was formed. The deposit was stripped from the substrate and subjected to the ASTM test, and was found to have a ductility without fracture of 11.1 percent, again with good corrosion resistance, smoothness, and a specular appearance.

EXAMPLE 5

For purposes of comparison, a conventional bath for producing amorphous nickel phosphorus alloy was used. The bath had the following composition:

1M nickel metal, 1.25M phosphorous acid, and 0.3M phosphoric (1M $Ni^{+2}$, 1.7M $Cl^{31}$). Note that the chloride ion is less than twice that of nickel in the bath.

Again electrodeposition was continued until the deposit had a thickness of about 25 microns, the deposit was stripped from the substrate so that the film configuration was a free-standing foil, and the foil was subjected to the ASTM micrometer test. It was determined that the sample had a ductility of 1.53 percent. Not only was the ductility much poorer than for the samples according to the invention, the sample actually failed by shattering into fragments (actually fracturing).

Figure 1:
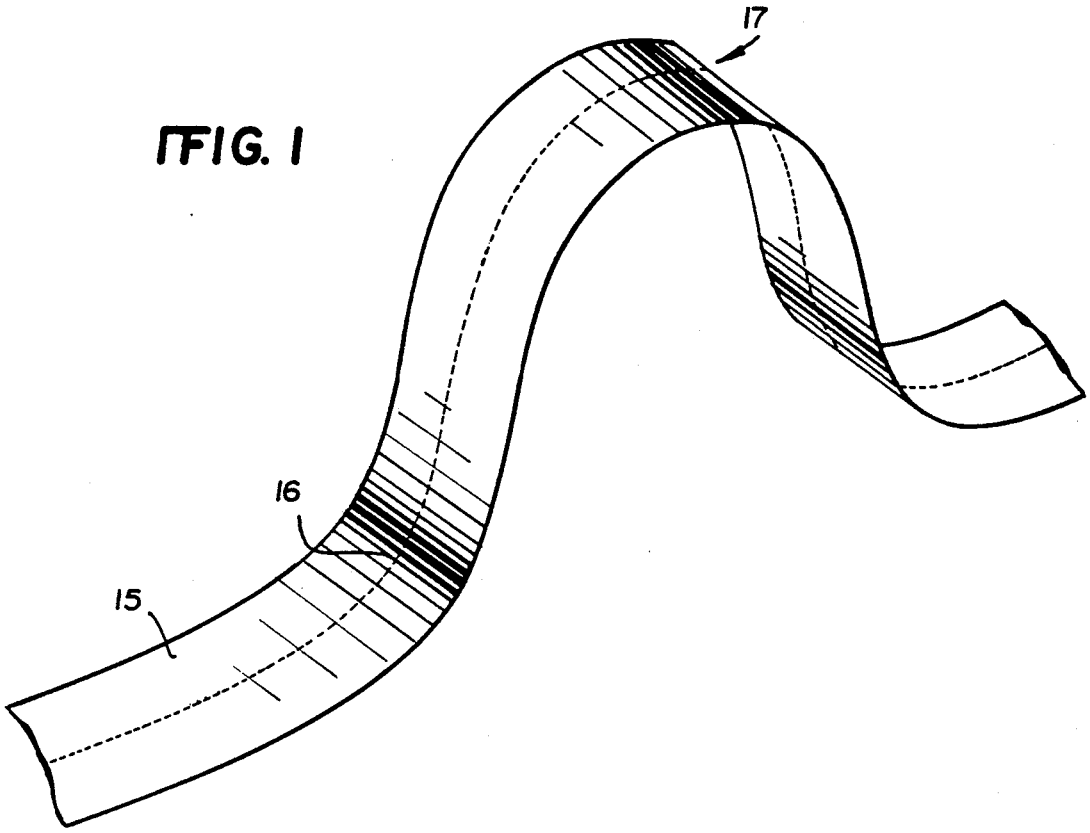
FIG. 1 is a top perspective view of an unsupported nickel phosphorus alloy film orifice plate that may be produced according to the invention, disposed in a bowed configuration to illustrate the excellent ductility thereof.

As a qualitative demonstration of the excellent ductility of products according to the present invention, foil samples 0.005 inches thick produced according to Example 1 were formed into orifice plates and bent into various complex geometric shapes (configurations). FIG. 1 illustrates such a nickel phosphorus foil orifice plate 15, comprising a main body with a plurality of small closely spaced orifices extending along the length thereof, and being visible as the line 16 in FIG. 1. FIG. 1 shows such an orifice plate formed so that it is bowed upwardly in the middle as indicated generally by reference numeral 17 in FIG. 1.

Figure 2:
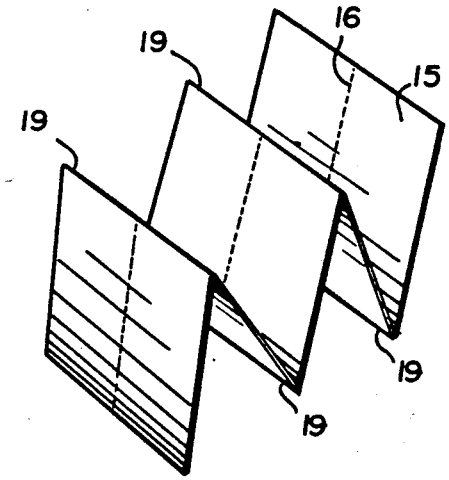
FIG. 2 is a top perspective view of a portion of the orifice plate of FIG. 1 that has been accordion folded, again to illustrate its ductility.

FIG. 2 illustrates a small portion of the plate 15 of FIG. 1. In this instance, the foil is accordion folded (see folds 19 ). This accordion folding is accomplished without cracking due to the initial folding (although if the sample is subjected to subsequent continuous flexing about the folds, cracking or breakage will occur).

Figure 3:
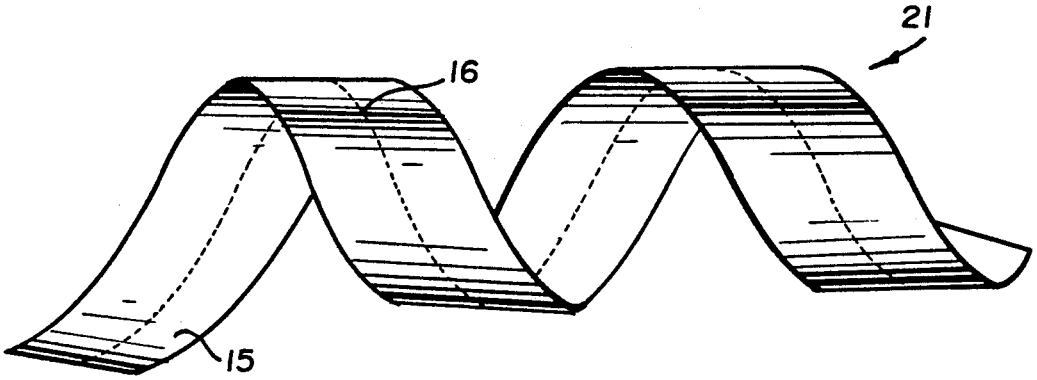
FIG. 3 is a top perspective view of a section of the orifice plate of FIG. 1 twisted into a helix, again to illustrate its excellent ductility.

FIG. 3 illustrates a portion of the plate 15, this time twisted into a helical configuration (helix) as illustrated generally by reference numeral 21 in FIG. 3. Again the twisting into the helical configuration is accomplished without cracking.

While the desired results according to the invention can be achieved, the mechanism that results in the improved ductility (while corrosion resistance, specular appearance, and smoothness are retained) is not completely understood. However since the desired results according to the invention are not achieved when weak acids (i.e. a buffered system), nitric acid, or the like are utilized in the bath, it is believed that the desired results are due at least in part to the high concentration of chloride ion and lower codeposited hydrogen content in the metal. A high concentration of chloride ion with respect to nickel (and greater than 1.25M) is thus desirable. However, if the concentration of chloride ion exceeds about 2.0 molar, the desirable property of the plating's resistance to nitric acid and warm ferric chloride corrosion is diminished, so the concentration of chloride ion has an effective upper limit of about 2.0 molar, for concentrated nitric acid and ferric chloride resistance.

While the specific examples discussed above were discussed in terms of the production of free-standing samples (foils), that was done merely for illustrative purposes, so that the ductility properties could be readily demonstrated (qualitatively or quantitatively). Of course, other film configurations can also be utilized, and in fact the invention is eminently suited for use in coating a wide variety of substrates, including plastics, and may desirably be employed for the production of magnetic recording tape, textile printing screens, and the like. Practically any substrate for which the properties of the film are desirable may be used. In the case of non-conductive substrates a conductivity-imparting electroless strike may precede the electrodeposition.

Also, while the invention has been specifically described with respect to nickel phosphorus, other transition metal phosphorus alloys also may be produced according to the present invention. For instance, cobalt may replace part, or all, of the nickel in the alloy. The terminology "nickel phosphorus alloy" in the specification and claims is also intended to encompass nickel-cobalt-phosphorus alloys.

It will thus be seen that according to the present invention a transition metal-phosphorus alloy having the desirable properties conventionally known for nickel phosphorous amorphous alloys plus enhanced ductility has been provided, as well as a bath for the electrodeposition thereof, and a method of production thereof. While the invention has been herein shown and described in what is presently perceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products, baths, and procedures.

What is claimed is:

1. A bath for electroplating an amorphous ductile nickel phosphorus coating on a substrate, comprising about 0.5–1.0 molar nickel, about 1.5–3.0 molar phosphorous acid, about 0.1–0.6 molar phosphoric acid, and about 0.0–0.6 molar hydrochloric acid, with chloride ion in the amount of at least 1.25M, and greater than twice as much chloride as nickel.

2. A bath as recited in claim 1 wherein the maximum amount of chloride ion is about 2.0 molar.

3. A method of producing an amorphous ductile nickel phosphorus alloy film configuration by electrodeposition on a substrate, comprising the step of immersing the substrate as a cathode in a bath containing about 0.5–1.0 molar nickel, about 1.5–3.0 molar phosphorous acid, about 0.1–0.6 molar phosphoric acid, and about 0.0–0.6 molar hydrochloric acid, with chloride ion in the amount of at least 1.25M, and greater than twice as much chloride as nickel; maintaining a temperature of about 5° C. –95° C. and a cathode current density of about 20–800 ma/sq. cm. until a coating having the desired thickness has been electrodeposited on the substrate.

4. A method as in claim 3 wherein said step is practiced so that the maximum amount of chloride ion is about 2.0 molar.

5. A method of producing an amorphous film configuration as recited in claim 3 in which said film is deposited at a rate of at least about 0.020 inches per hour.

6. A method of producing an amorphous ductile specular nickel phosphorus alloy film configuration resistant to nitric acid corrosion, by electrodeposition on a substrate, comprising the step of immersing the substrate as a cathode in an unbuffered bath including nickel, phosphorus, and hydrochloric acid in an amount sufficient to obtain nitric acid corrosion resistance, with an upper limit of chloride ion of about 2.0 molar, and greater than twice as much chloride as nickel, until a desired thickness of alloy has been deposited on the substrate.

7. A self-supportable amorphous nickel phosphorus alloy foil orifice plate having a thickness about 1 mil or greater and resistant to attack by nitric acid and/or warm ferric chloride and having sufficient ductility properties such that a 25 micron thick sample of the alloy foil orifice plate may be formed into a complex geometric shape without actual fracturing, the complex geometric shape having at least one bend radius equal to the thickness of said orifice plate.

8. An orifice plate as recited in claim 7 having ductility properties such that its ductility is comparable to at least about 5 percent for a 25 micron foil subjected to the ASTM Micrometer Bend test for Ductility of Electrodeposits.

9. An orifice plate as recited in claim 7 having ductility properties such that its ductility is comparable to at least about 10 percent for a 25 micron foil subjected to the ASTM Micrometer Bend Test for Ductility of Electrodeposits.

10. An amorphous nickel phosphorus alloy foil orifice plate having a thickness about 1 mil or greater and resistant to attack by nitric acid and/or warm ferric chloride and having sufficient ductility properties such that a 25 micron thick sample of the alloy foil orifice plate may be formed into a complex geometric shape without actual fracturing, the complex geometric shape having at least one bend radius equal to the thickness of said orifice plate, and wherein the alloy foil orifice plate exhibits a smooth, specular surface, the alloy foil orifice plate being produced by electrodepositing the nickel phosphorus alloy foil at a rate of at least about 0.001 inches of foil thickness per hour.

11. An amorphous nickel phosphorus alloy film configuration resistant to nitric acid and/or warm ferric chloride corrosion and having ductility properties such that when said alloy film is in a 25 micron thick foil configuration it is capable of being deformed to 100 percent ductility by the ASTM Micrometer Bend Test for Dcutility of Electrodeposits without actually fracturing, but rather remains coherent with microscopic cracks on the surface and wherein said film configuration comprises a coating on a substrate.

12. A film configuration as recited in claim 11 wherein said substrate is plastic, and wherein said substrate includes a conductivity-imparting layer on which said film is coated.

13. A film configuration as recited in claim 11 wherein said film configuration is produced by electrodepositing the nickel phosphorus alloy coating on a substrate by immersing the substrate in a bath comprising about 0.5–1.0 molar nickel, about 1.5–3.0 molar phosphorous acid, about 0.1–0.6 molar phosphoric acid, and about 0.0–0.6 molar hydrochloric acid, with chloride ion in the amount of at least 1.25M, and greater than twice as much chloride as nickel, maintaining the cathode current density at between about 20–800 ma/sq.cm., and maintaining the bath at an operating temperature of about 55°–95° C., until a coating of desired thickness has been produced.

* * * * *